United States Patent [19]

Scheer et al.

[11] 4,084,104

[45] Apr. 11, 1978

[54] ELECTRIC SIGNALING ARRANGEMENT FOR DELIVERY OF WAKING SIGNALS

[75] Inventors: Erich Scheer, St. Georgen-Peterzell; Manfred Rauer, St. Georgen-Stockwald, both of Germany

[73] Assignee: Kieninger & Obergfell, Fabrik fur technische Laufwerke und Apparate, St. Georgen, Germany

[21] Appl. No.: 670,715

[22] Filed: Mar. 26, 1976

[30] Foreign Application Priority Data

Mar. 26, 1975 Germany ..... 2513384

[51] Int. Cl.[2] ..... H01H 7/00

[52] U.S. Cl. ..... 307/141; 58/21.15; 340/309.4

[58] Field of Search ..... 307/141, 141.4, 141.8; 58/21.15; 340/309.4

[56] References Cited

U.S. PATENT DOCUMENTS

| | | | |
|---|---|---|---|
| 3,456,123 | 7/1969 | Pihl | 307/141 |
| 3,728,855 | 4/1973 | Preiser | 58/38 R |
| 3,822,547 | 7/1974 | Fujita | 58/38 R |
| 3,834,153 | 9/1974 | Yoda et al. | 58/38 R |
| 3,996,734 | 12/1976 | Kitai et al. | 58/38 R |

*Primary Examiner*—Robert K. Schaefer
*Assistant Examiner*—Morris Ginsburg
*Attorney, Agent, or Firm*—Karl F. Ross

[57] ABSTRACT

An electric clock having clockwork is provided with a signaling arrangement which automatically resets for operation of an alarm or waking signal and does not require resetting each day by the user. Resetting is accomplished by a contact device which switches on once during each twenty four hour period at a preselected hour corresponding to the hour at which the alarm is to begin. A second contact device switches on for a brief period during each hour and triggers a bistable multivibrator which is automatically reset each hour. The output of the bistable device is applied to a logic circuit whose other input derives from a third contact device setting the minute at which the alarm is to be initiated.

12 Claims, 8 Drawing Figures

ELECTRIC SIGNALING ARRANGEMENT FOR DELIVERY OF WAKING SIGNALS

FIELD OF THE INVENTION

The invention relates to an electric signaling arrangement, in particular, for delivery of waking signals having a clockwork-actuated contact device switching-on in the course of a 24-hour cycle once at a pre-selectable instant and a further clockwork-actuated contact device switching-on in the course of a 60-minute cycle at a pre-settable instant during a maximum signal duration, wherein in response to a common switching-on of both the devices a potential is supplied to a waking-signal transmitter and the duration of the maximum signal is limitable, as required, by means of an associated manually operable signal-interrupting switch.

The object of the invention is to achieve an improvement and simplification in the electrical signaling arrangement known hitherto especially for delivery of waking signals.

BACKGROUND OF THE INVENTION

From German Published Patent Application DT-OS-1,965,205 there already has become known an electrical signaling arrangement, especially for delivering waking signals, which corresponds to the arrangement defined above. In this known arrangement, the clockwork-actuated contact devices are forcibly coupled to digital indicating drums advanced stepwise for an hour and a minute. Both of the contact devices, which are actuated by clockwork, are connected in series with one another and to a waking-signal transmitter. By means of a signal-interrupting switch in this circuit, it is possible to manually limit or also totally interrupt the maximum signal delivery in case the signal output is not desired. However, the cost of a digital indication is significant. This expenditure is justified where the digital indication of the clock time is desired or required in connection with a minute-precise waking arrangement as has been proposed in said Published Patent Application. In many cases such a digital indication of the clock time is not required and an analog indication of the clock time is sufficient for the electrical signal arrangement.

In the known published electrical signaling arrangement according to German Published Patent Application DT-OS 1,965,205, it is necessary, after the signal delivery has been manually interrupted, to manually reset the position "Alarm" or "Signal Delivery" before the delivery of a new desired signal.

If this switch-over is forgotten or unattended to, the future generation of the desired waking signal will not occur.

In this prior-art electrical signal arrangement according to German Published Patent Application DT-OS 1,965,205, the charging current necessary for feeding the signal producer flows through the control contacts of the clockwork. For this reason, this contact structure must be correspondingly constructed and ought to be operated with an elevated pressure.

OBJECT OF THE INVENTION

The invention has the object of providing minute-precise settable electrical signaling arrangement, particularly for generation of waking signals, which arrangement has respective time-switching units of simple construction, automatically resets again to generate signals, which is controlled by simple, lightly actuatable contacts, and which performs precisely and reliably its functions even where use is made of an analog indication of the clock time.

SUMMARY OF THE INVENTION

Basically it is possible to associate the waking signal starting unit utilized in the subject matter of the aforecited German Published Patent Application with a clockwork having a continuous analog time indication. But, here problems arise with respect to the dimensioning of the starting and setting discs, so that there would result unreliability in function in the absence of specific means for preventing the same.

Such functional unreliability derives from the fact that the proportional angular speed as to hour and minutes of a starting unit, with independent setting of the same, results in the dislocation of the contact sectors whereby under certain conditions a precise signal delivery is hampered.

When, namely, the minute-precise waking signal starting unit according to said DT-OS 1,965,205 is not actuated in the way as disclosed therein by elements of digital indication, but by a time-switching work with an analog time indication, there arise difficulties with respect to tolerances and to the production precision of the utilized starting means. There also is needed a very precise setting of the starting means, for ensuring reliable functioning. Another possibility of eliminating such difficulties lies in associating with the analog-indicating time switching work, special stepping-switch works between the driving shafts and the starting means for hour and minute. This, however, significantly increases the cost.

The invention attains the aforesaid object in that the contact device switching once at a presettable instant in the course of a 24-hour cycle is settable from hour to hour and is adjusted so that it is always switched on within the range of a full preset hour. This contact device, being electrically coupled with another further associated contact device switching briefly at each full hour and also actuated by a clockwork, triggers a bistable electronic holding circuit, whose output is electrically connected via an electrical logic circuit with a contact device switching in the course of a 60-minute cycle at a resettable instant during a maximum signal duration. The output of the logic circuit is applied to a signal generator that is controlled in the course of the following 60 minutes by a preset switching contact device while on the next brief switching of the contact device over each full hour, the electronic holding circuit is again extinguished.

A specific further development of the invention resides in that the clockwork-actuated contact device is switched once at a presettable instant in the course of a 24-hour cycle, is operated continuously and is switched on between shortly before and shortly after the preset full hour and that this contact device, as well as the contact device switching in the course of a 60-minute cycle at a presettable instant during the maximum signal duration, both of them independently from one another, indexed step-by-step from one hour to another hour, or from one minute set unit to another minute set unit, are manually settable, the maximum signal duration being equal to, or shorter than, a minute set unit which by itself represents an integral partial factor of 60 wherefrom the first begins at a full hour (00).

In a preferred embodiment of the invention, the briefly effective contact device is connected at a full hour on the one hand, to the potential (voltage source) and, on the other hand, firstly via a contact device switching at a settable instant in the course of a 24-hour cycle to the setting input of the bistable electronic holding circuit and, secondly, via a capacitor to the reset input of the bistable electronic holding circuit. The contact device switching in the course of a 60-minute cycle at a resettable instant for the maximum signal duration is coupled, on the one hand, to source potential, and, on the other hand, to an input of the logic coupling whose output is applied to the signal generator, the other input whereof is coupled to the output of the bistable electronic holding circuit. A further feature of this preferred embodiment of the invention has the contact device, switching briefly at each full hour, coupled to source potential, on the one hand, and, on the other hand, via the contact device switching once in the course of 24-hour cycle at a pre-settable instant and via a first capacitor to the switching input of the bistable electronic holding circuit and, besides, via a second capacitor, to its reset input, that the capacitors are connected at the side opposite the bistable electronic holding circuit via at least one resistor with an O-potential and the switching-over of the bistable electronic holding circuit is produced by a compensating current pulse flowing on switching-off of the contact device switching briefly at each full hour across one of the capacitors. The dimensioning of both the capacitors and of their compensating circuits is such that the compensating current pulse flowing through the first capacitor is temporarily of a greater duration than the compensating current pulse across the second capacitor, and that the contact device switching-on in the course of a 60-minute cycle at the pre-settable instant for the duration of the maximum signal delivery is coupled, on the one hand, to the potential, on the other hand, to an input of the logic circuit whose output acts on the signal generator, whose other input is coupled to the output of the bistable electronic holding circuit.

The structure of such an electrical signaling arrangement, and, in particular, one for delivery of electrical waking signals, as the invention provides, is able to overcome the difficulties found to be connected with the known arrangement and there is also obtained a reliable and precise signal output.

SPECIFIC DESCRIPTION

Figure 1:
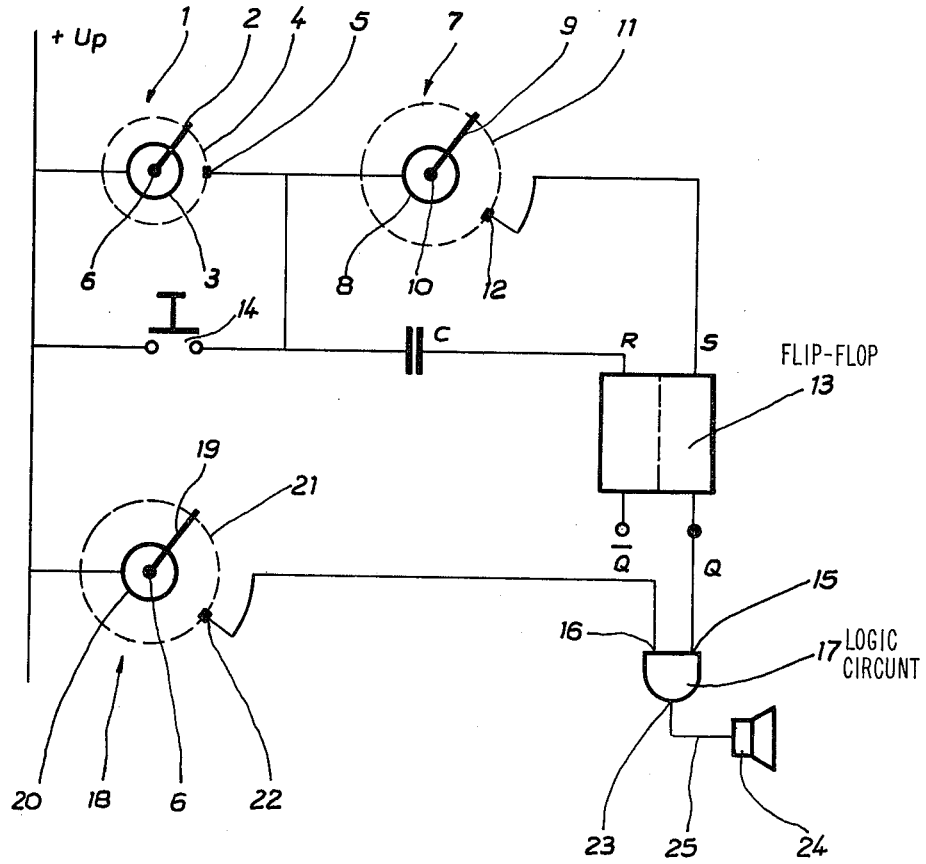
FIG. 1 is a circuit arrangement according to the invention.

In FIG. 1, a clockwork-driven contact device 1 closes briefly once in 60 minutes, namely at a full hour. This contact device comprises a rotating slider 2 driven by a clockwork (not shown in FIG. 1) and cooperating with contact paths 3 and 4. The contact path 3 is continuous and is electrically tied to a +Up source potential. The contact path 3 serves for a continuous connection of the slider 2 with the conductor supplying the +Up potential.

Upon the contact path 4, a contact element 5 is fixedly positioned. The positioning of the slider 2 which is carried by a driving shaft 6 and is driven thereby is selected so, with regard to the contact element 5, that the slider 2 makes contact with the contact element 5 always at each full hour. In the switching arrangement of FIG. 1, the contact closure between the contact element 5 and the slider 2 occurs precisely at each full hour and opens again 20 – 30 seconds later.

In series with the contact arrangement 1, there is connected a further contact arrangement 7 having a structure substantially identical with that of the first contact arrangement. The contact element 5 of the contact arrangement 1 is coupled via a conductor to the continuous contact path 8 of the contact arrangement 7 being swept by a corresponding slider 9 mounted upon, and driven by, a driving shaft 10. The slider 9 also sweeps over a further contact path 11 upon which a contact element 12 is adjustably mounted along this path. The slider 9 makes on its driving shaft 10 a full rotation in 24 hours, while the contact element 12 indexes step-by-step with a dwell from one hour to the other along the contact path 11 and is resettable therealong. The contact element 12 is in turn electrically connected with an input S of a bistable electronic holding circuit 13 included in an integrated circuit, e.g. a bistable multivibrator circuit or flip-flop.

The electrical interconnection between the contact element 5 positioned on the contact path 4 and the contact path 8 of the contact arrangement 7 swept over by the slider 9 is coupled via a capacitor C to the reset input R of the electronic flip-flop 13.

The so-called switching input S is the input "set" of the bistable electronic circuit 13 during the supply of the current whereby the bistable multivibrator or flip-flop from a rest condition, is triggered to the switched-on condition whereupon there appears a potential at the output Q of this electronic bistable circuit 13.

The electrical energization of the so-called reset input R of the bistable electronic multivibrator causes a return switching of the same to the starting or rest condition in which it remains and during which the output Q is free of any potential. The bistable multivibrator is in addition connected by nonillustrated conductors to the +Up potential and the potential 0. Through these conductors, the multivibrator is provided with potential maintaining its controlled static states.

Between the +Up potential and the electrical connection leading from the contact element 5 of the contact arrangement 1 to the contact path 8 of the contact arrangement 7 is connected a signal cut-off key 14. This signal cut-off key 14 makes it possible, as will be explained in more detail hereinafter, to manually energize the reset input of the bistable electronic circuit 13 independently on the clockwork-actuated contact arrangement 1, whereby a foreshortening may be obtained of the signal delivery.

The output Q of the electronic flip-flop 13 is coupled to the input 15 of an electronic logic circuit 17. To its other input 16, the +Up potential is connectable via a third contact arrangement 18.

The contact arrangement 18 has a structure fully identical to the described contact arrangement 7. A slider 19 sweeps over a contact path 20 which is circularly continuous and is electrically connected to the +Up potential. On another contact path 21 also being swept over by the slider 19, a contact element 22 is arranged which is resettable along this contact path, preferably with indexing.

The indexed setting occurs with minute setting units. Each minute setting unit represents an integral fraction of 60 minutes, i.e. of one hour.

Thus a minute setting unit can be 1 to 6 minutes. Preferably it is one minute or two minutes, or even five minutes for each minute setting unit. In the first case, there would be 60 setting steps at the contact arrangement 18, in the second case there would be 30 setting steps and in the third case, i.e. in the case of a minute setting unit comprising 5 minutes, 12 setting steps for 60 minutes.

The slider 19 of the contact arrangement 18 carries out within 60 minutes one full revolution. The driving shaft 6 of the contact arrangement 1 effects an entire revolution within 60 minutes, so that the slider 19 is preferably also arranged on the driving shaft 6 and is driven thereby. The contact element 22 is electrically connected with the input 16 of the electronic circuit 17. Also the electronic circuit 17 is advantageously produced by integrated electronic semiconductor techniques, and forms with the bistable electronic holding circuit 13 a single structural unit.

In the electronic logic circuit 17 use can be made of either passive or active electronic elements. In the latter case, the electronic coupling 17 is provided with conductors (not represented) for getting the +Up potential and the O potential.

At the output 23 of the electronic coupling 17, a signal generator 24 is connected via a conductor 25. In this conductor 25, a nonillustrated interrupter of the signal duration can be arranged, this interrupter blocking for the duration of its activation the signal delivery by the signal generator 24. This signal generator 24 may be an electrical or electronic buzzer. However, also other types of signal generators are conceivable at this place, such as an electrical or electronic bell, hooter, gong or the like.

When the positioning and dimensioning is made of the contact arrangement 18, it is to be kept in mind that the extent of the contact elements 22 along the contact path 21 and relative to the slider 19 can be only so great that the duration of the signal delivery resulting from the contacting touch between the slider 19 and the contact element 22 is shorter than or at most equal to the minute setting unit settable with the resting stop on the contact arrangement 18. There is to be further observed such a positioning of the contact element 22 relative to the slider 19 that the setting of the first minute setting unit for the following 60-minute cycle occurs at the full hour X h 00 min. Where a 2-minute set minute setting is chosen, i.e. where the contact arrangement 18 is settable from 2 minutes to 2 minutes, the following setting mode possibly results:

Xh 00 min., Xh 02 min., Xh 04 min., and so forth - to (X+1) 00 min. X in this case means a corresponding hour whereat the setting is made, (X+1)h signifies the next hour following.

The observance of these dimensioning conditions for adjustments is important for a failureless and precise function of the arrangement according to the invention.

Figure 2:
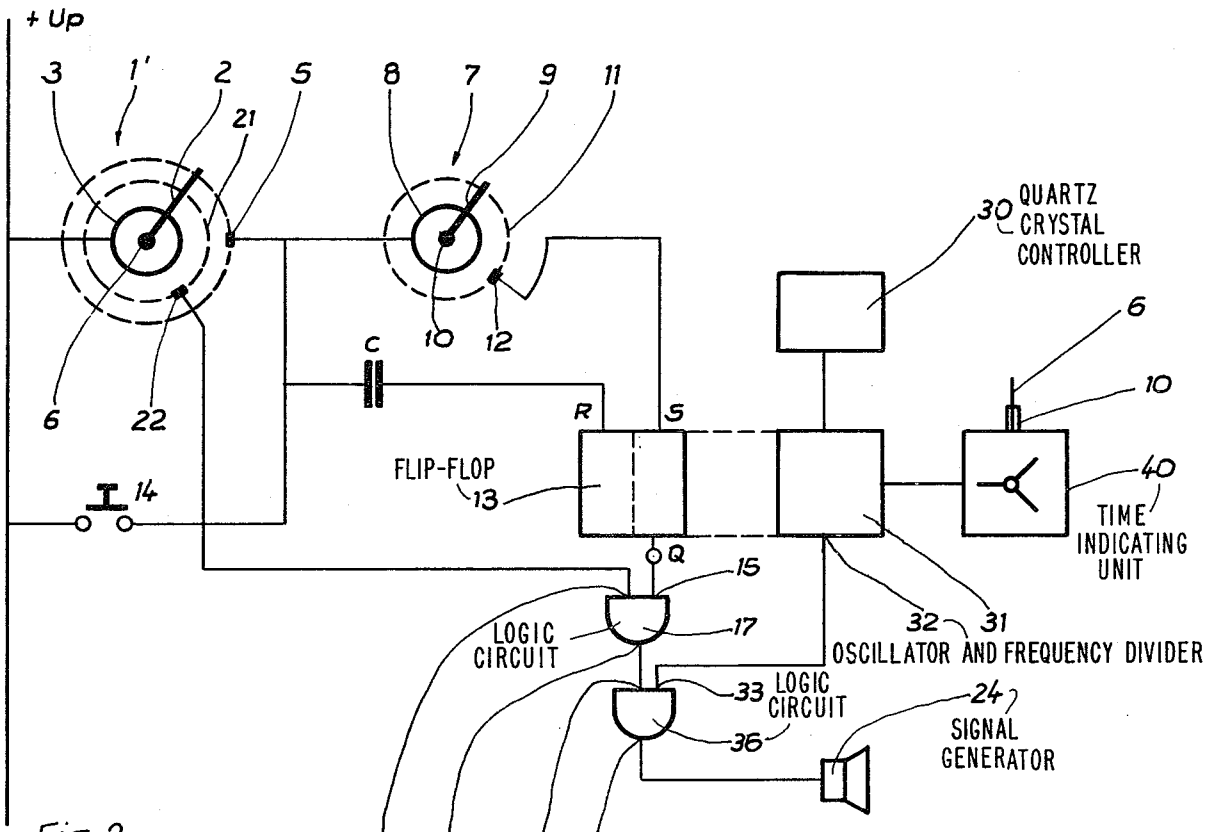
FIG. 2 is a modification of the circuit arrangement according to FIG. 1.

In the arrangement according to FIG. 2 a preferred modification is shown of the contact arrangements 1 and 18 of FIG. 1, the same being unified into a single contact arrangement 1'. The slider 2 of the previous contact arrangement 1 is associated additionally also with the contact path 21 of the contact arrangement 18 of FIG. 1. On this contact path 21, the contact element 22 is arranged, which is resettable over the range of 60 minutes. The contact element 22 is connected electrically with the input 16 of the electronic circuit 17.

Both the contact arrangements 1 and 18 are actuated by a common driving shaft 6 and are therefore arranged together on this shaft, so that the assembly of both the contact arrangements according to this further development of FIG. 2 represents an important simplification.

The contact element 5 of the contact arrangement 1 according to FIG. 1 is fixed and does not experience any displacement; therefore, the contact element 5 of the contact arrangement 1 and the contact element 22 of the contact arrangement 18 may be swept over in common by the slider 2.

This arrangement represents a simplification not only from the standpoint of the switching technique but also has a very favorable effect with regard to the structural configuration of both the combined contact arrangements 1 and 18 in one common contact arrangement 1'. This condensed contact arrangement 1' can be effected on one plane, i.e. for instance on a printed circuit board (with printed leads), while in case of the arrangement according to FIG. 1 two structures were necessary.

According to another preferred modification of the switching arrangement of FIG. 1, in accordance with FIG. 2, the arrangement cooperating immediately with the signal deliverer, is connected with the input part of the quartz crystal controlled switch in such a manner that there ensues an intermittent signal delivery.

The progressive development of miniaturization of combined and condensed semi-conductor building elements has made available electronic quartz crystal controls for driving electrical watches and timing switching works. In particular, in electrical signal arrangements, and preferably those delivering waking signals, the association of an electronic quartz controlled time switching work provides an important advantage, since there is provided a timely correct and functionally secure actuation of the signal-delivering contact arrangements and thus it is superfluous to supervise or correct the indicating conditions of the time switching work for a very long time period of many months.

According to the switching arrangement shown in FIG. 2, the switching part of the quartz crystal controlled time switching work includes a controlling quartz crystal 30 connected to an integrated electronic circuit 31. This integrated electronic circuit 31 includes the elements of a quartz crystal oscillator stage, as well as elements of diverse frequency divider stages. There are comprised in the circuit 31 also a pulse former and pulse drive stages. The electronic coupling 31 is connected to an indicating unit 40 of the quartz crystal controlled time switching work, said unit containing a second stepping motor and the indicators for indication of the time. The driving shafts 6 and 10 for actuation of the contact arrangements 1' and 7 are led out from the unit 40.

The output 23 of the electronic circuit 17 is coupled to the input 34 of a further electronic circuit 36 also providing connection, the second input whereof is coupled to the output 32 of the electronic circuit 31. The output 32 is connected to the last stage of the frequency divider and leads to the input 33 of the electronic coupling 36 whereto it supplies seconds pulses. In this way, there are fed via the logic connection of both the inputs 33 and 34 to the signal deliverer 24 a sequence of seconds pulses. In this way, there are fed via the logic connection of both the inputs 33 and 34 to the signal deliverer 24 a sequence of seconds pulses the consequence whereof is an intermittent signaling by the signal generator 24.

There exists the possibility to enlarge the extent of the dividing stages of the electronic coupling 31 without this involving any significantly higher expense. In this manner, a delivery of signaling sequences is obtained which include pauses of several seconds and short pulses of about 1 . . . 2 seconds. For this purpose, it is preferred to have co-coupled the last divider stage having one or several outputs also over an electronic circuit so that there is set up a superimposition of different dividing frequencies.

It is also conceivable to feed to the signal generator 24 directly a divider frequency within the sonic frequency range and arriving from the electronic coupling 31, so that there is no need for a special frequency-producing means in the signal generator 24.

Preferably, the electronic couplings 13, 17, 31 and 36 are combined to form a single integrated electronic circuit unit. There can be associated with the integrated circuit unit also other building electronic elements, as for instance the electronic elements pertaining to an oscillator circuit immediately associated with the signal generator 24.

Figure 3:
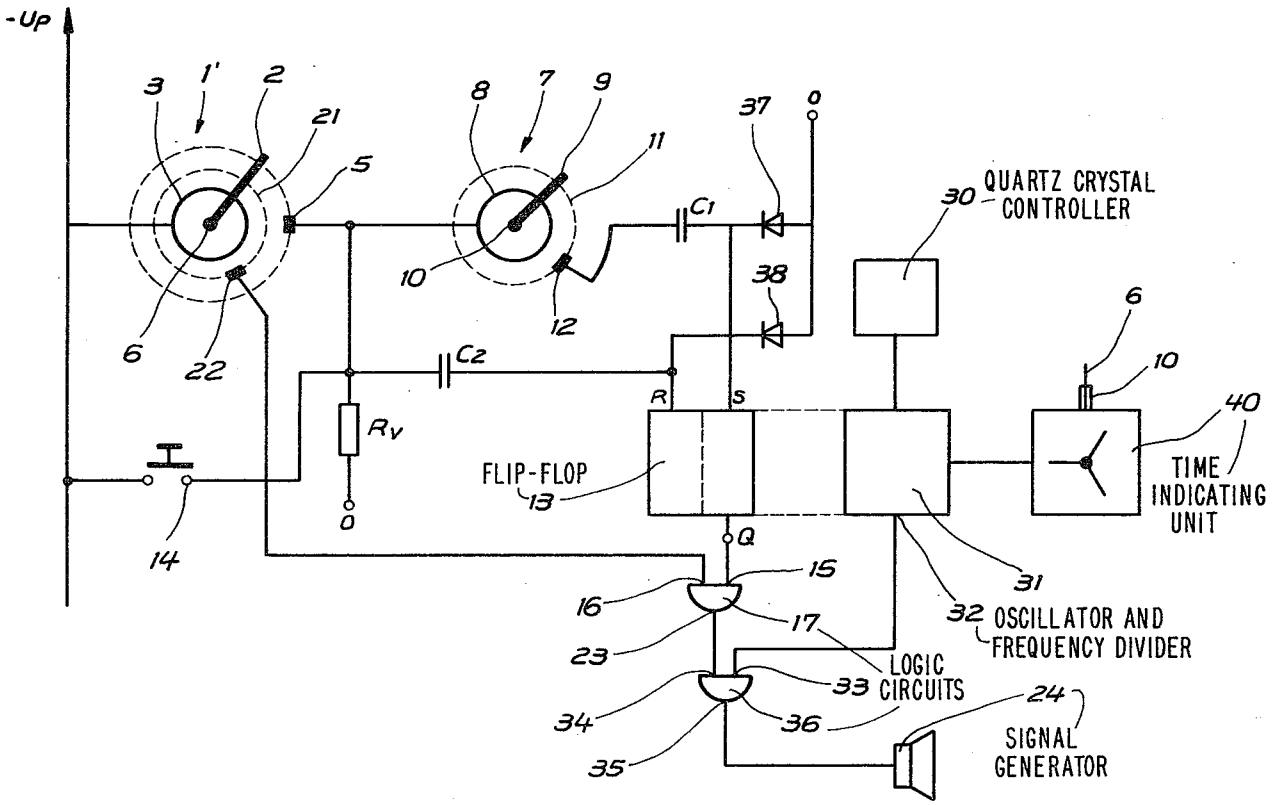
FIG. 3 is a modification of the circuit arrangement according to FIG. 2.

FIG. 3 shows a coupling arrangement being a further variant of the circuit arrangement shown in FIG. 2, there being pre-coupled to the switching input S of the electronic bistable holding circuit 13 also a capacitor C1.

Besides, the switching input S and the reset input R of the electronic bistable holding circuit 13 are connected, respectively, across blocking diodes 37, 38 to 0-potential. Thereby, the capacitor C1 is dimensioned with regard to the capacitor C2 in a manner such that the charging and discharging operation via the capacitor C1 — which operation will be described in more detail hereinafter — extend over a longer duration than that of the capacitor C2. The capacitor C2 corresponds to the capacitor C of the coupling arrangement illustrated by FIGS. 1 and 2 which capacitor is pre-coupled to the reset input R of the electronic bistable holding circuit 13.

Figure 4:
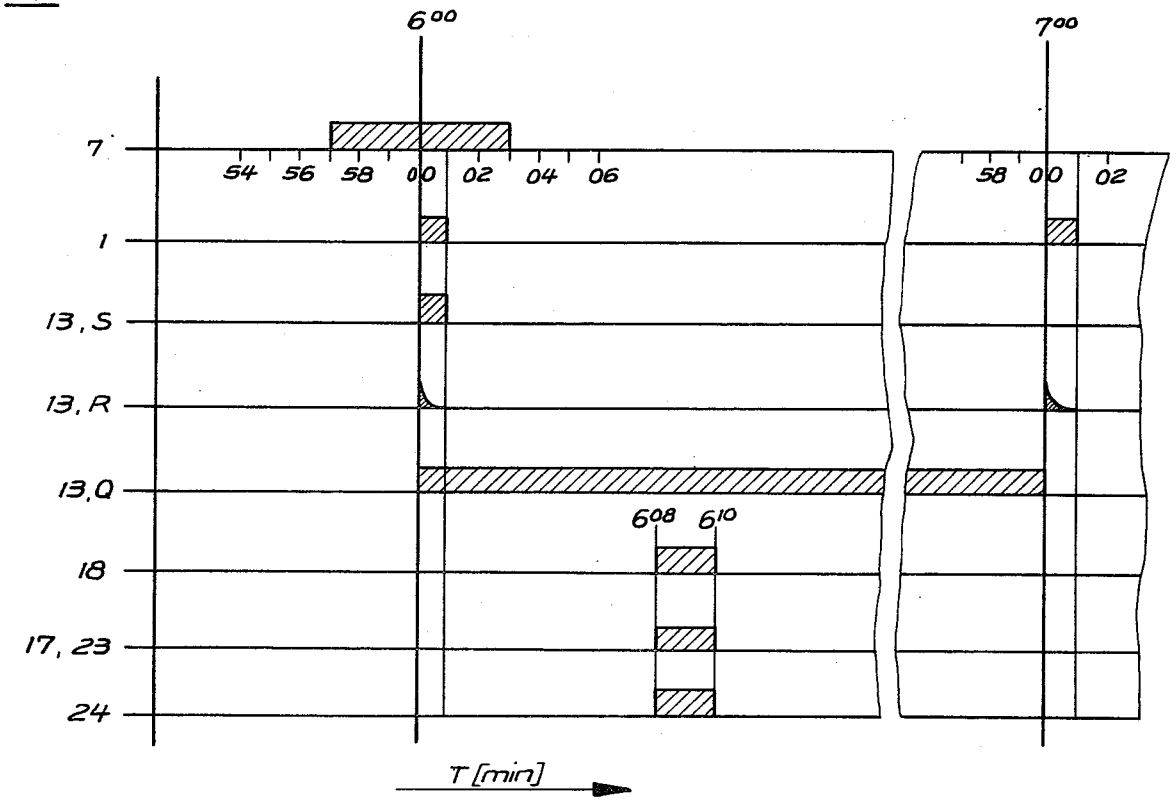
FIG. 4 is a time diagram for clarifying the functional steps of the circuit arrangement according to FIG. 1.

The functional procedures of the described coupling arrangements develop as follows:

In the coupling arrangement of FIG. 1, on the contact device the contact element 7, as is is visible from the time diagram of FIG. 4, closes at 5:57 o'clock. The contact element 7 is manually set by hour-wise indexing resetting of the contact element 12 at 6 o'clock. A correspondingly performed adjustment and measurement of the slider 9 in regard to the contact element 12 conditions the closing of the continuously actuated contact element 7 within the range between the 57th minute of the preceding and the 0,3 minute of the subsequent hour, all this within a preselected hour range. At 6:00 o'clock, the contact device 1 closes, so that there is formed a current circuit from +Up, through the contact device 1, the contact element 7 to the switching input S of the bistable electronic holding circuit 13.

At the same time, a current circuit is formed from +Up across the contact device 1, the capacitor C to the reset input R of the bistable electronic holding circuit 13. The reset input R thus receives a charging pulse of the capacitor C which pulse delays for a short time the switching-over of the bistable electronic holding circuit 13; after the charging of the capacitor C has terminated, the energization of the switching input S across the contact element 7 becomes effective. The bistable electronic holding circuit 13 switches on to an output at Q that is connected to an input 15 of the electronic logic coupling 17.

After the expiration of short time span, the contact device 1 opens; however, the switched-on condition of the bistable sweep stage 13 remains maintained and its output Q continues to be under current charge.

At 6:03 o'clock, the contact element 7 reopens. The duration of actuation of this contact element 7 is not critical; what is important, however, is that this contact device be closed at 6:00 o'clock. The actuation velocity of the contact element 7 is slow and an impreciseness in the backlash teeth may occur and, with regard thereto, there is very appropriate a closure duration symmetrically distributed around the moment of 6:00 o'clock, this being at the contact element 7 in the total value of 6 to 10 minutes.

Correspondingly to the pre-setting of the contact unit or element 18, the same switches at 6:08 o'clock the input 16 of the logic circuit 17 to the +Up potential.

This results in a connection of both the inputs 16, 15 of the logic circuit 17, so that the output 23 receives current and the signal generator 24 is energized via the connection 25.

The signal switching-off key 14 can be actuated to cause a current supply for a short period to the reset input R of the bistable electronic holding circuit 13 via the capacitor C, in response whereto the holding circuit 13 switches over, so that the output Q becomes uncharged by current. In effect thereof, the connection provided across the logic circuit 17 is rescinded and the signal generator 24 is muted.

When the signal switching-off key 14 is not actuated, the contact unit 18 opens at 6:10 o'clock, thus switching off also the connection to the logic electronic circuit 17 together with the original signal generator 24.

The maximum duration of the signaling provided in the exemplary embodiment according to FIGS. 1 and 4 amounts to 2 minutes. For ensuring a secure and exact functioning, there is provided in the contact unit a minute setting range and/or a setting division for each two minutes, the same starting with a full hour (00), thus being possible to have a setting position at each second minute. It is self-understood that there is possible also a setting in minute spacings in the contact unit 18 in which case, the maximum duration of the signal delivery must be limited to 1 minute. As a rule, a one-minute signal duration is sufficient.

The closing duration of the contact device 1 may be possibly very short. The contact closing starts at 6:00 o'clock and the role of contact device 1 is ended when the holding circuit 13 becomes closed, so that the former can be switched off. However, in view of tolerance influences and of gearing play, there ought to be guaranteed a closing duration of 20 . . . 30 seconds, according to what the need may be.

Figure 5:
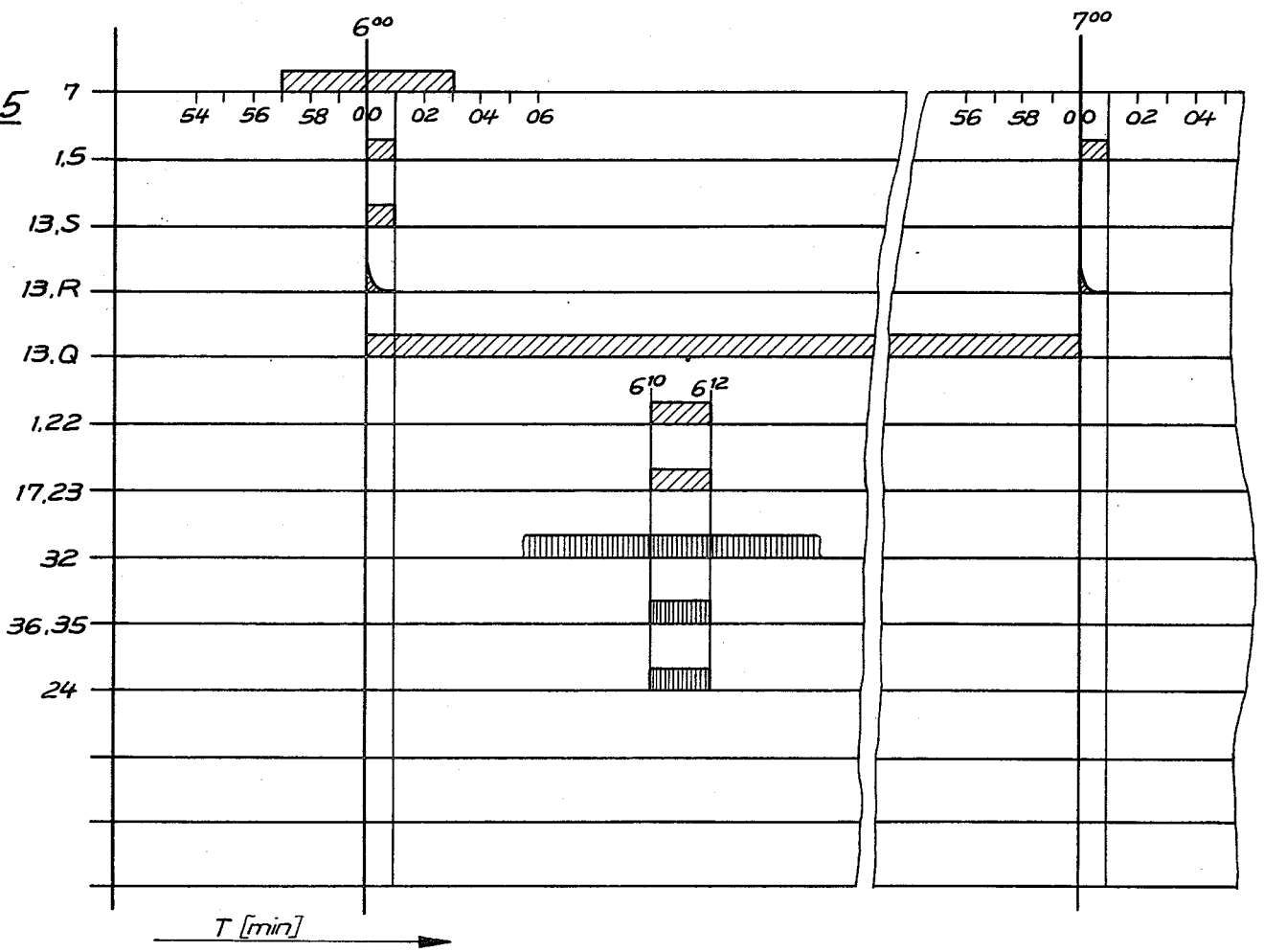
FIG. 5 is a time diagram for clarifying the functional steps of the circuit arrangement according to FIG. 2.

FIG. 2 and the time-diagram according to FIG. 5 pertaining thereto show a further variant embodiment of the circuit arrangement according to FIG. 1 where the signal trapped at the output 23 of the logic coupling 17 is linked to a pulse sequence leaving at the connection 32 of a frequency divider and modulation is made in the logic coupling 36. Here, the signal delivery by the signal deliverer 24 occurs rhythmically intermittently, the pulse-pause relation being determined by the form of the signal collected at the frequency divider 31. The signal deliverer 24 thus sounds in the rhythm of the pulses fed thereto, so that a better attention to the waking signal is ensured. As has already been mentioned, it is feasible to enlarge the frequency divider 31 and thus to obtain a pausing period far exceeding the second rhythm between the individual tone sequences of the signal deliverer 24.

Since such further divider stages can be located on the same semiconductor chip upon which the remaining divider stages are provided which are needed for the quartz crystal control, the costs for this additional variant are bearable.

The time-diagram of FIG. 5 shows the superimposition of the pulse of the output 23 of the electronic circuit 17 which pulse lasts from 6:10 to 6:12 o'clock by the pulse frequency of the output 32. The output 23 is continuously current-loaded, wherefore there is possible at any time that onto the signal appearing at the output 23 of the logic circuit 17 a divider frequency output signal is superimposed.

The coupling arrangement according to FIG. 3 is a further variant of the coupling arrangement illustrated by FIG. 2. Here, in the conductor between the contact device 7 and the switching input S of the bistable electronic holding circuit 13, a capacitor C1 is interposed, similarly as there is interposed one capacitor C2 in the interconnection between the contact device 1' and the reset input R of the holding circuit 13. Thus, the energization of the switching input S of the sweep stage 13 occurs also pulse-wise through the capacitor C1. Instead of the +Up potential, there is provided a −Up potential and both the inputs R and S of the bistable electronic holding circuit 13 are coupled via a blocking diode 37, 38 to an 0 potential.

Furthermore, to the junction of the capacitor not coupled to the reset input R, a resistor Rv is connected which proceeds from the 0-potential; the same is provided as a discharge resistance.

When a contact closing in the contact device 1' occurs, after the contact device 7 has already closed, initially the capacitor C1 is charged, namely through the current circuit:

0 potential, diode 37, capacitor C1, contact devices 7 and 1', −Up potential.

The capacitor C2 is charged at the same time through the following current circuit:

0 potential, diode 38, capacitor C2, contact device 1', −Up potential.

The inputs S and R of the sweep stage 13 remain uninfluenced by these charging operations, because they are bridged in the direction of the charging currents by the diodes 37 and 38. When the contact device 1' becomes open, i.e. when the slider 2 leaves the contact element 5, which occurs after about 20 - 30 seconds, then there become effective instantaneously the compensating current circuits for the capacitors C1 and C2, namely capacitor C1, switching input S of the sweep stage 13, a nonillustrated junction to the 0 potential in the flip-flop circuit 13, resistor Rv, contact device 7, capacitor C1; and capacitor C2, reset input R of the sweep stage 13, a nonillustrated junction to the 0 potential in the flip-flop circuit 13, resistor Rv, capacitor C2.

The capacitive values of C1 and C2 are selected in such manner that they lead, in connection with the circuit resistors becoming effective, to such time constants that the discharging operation of the capacitor C1 exceeds that of the capacitor C2, i.e. it lasts temporally longer than that of C2.

In consequence hereof, only the discharging by the capacitor C1 towards the switching input S of the flip-flop 13 is effective, that means it switches on the signal at the output Q. This is always the case when the contact device 7 is closed.

This described operation of charging and discharging repeats after 60 minutes, at which time the contact device 1' closes or opens anew, this however only on the capacitor C2, because the contact device 7 is no longer closed. The discharging operation of C2 at the moment of opening of the contact device 1' is there not accompanied by a contemporaneously occurring discharging operation of the capacitor C1. Consequently, there become charged just the reset input R of the sweep stage 13, thus being actuated the reset coupling of the sweep stage 13. In the meantime, the contact device 1' has mediated across the slider 2 and the pre-settable contact element 22 the signaling at the pre-set instant.

The start of the signaling, as well as the reset switching of the flip-flop 13 are produced, respectively, by the discharge of the capacitor C1 or C2, charged earlier. This is clearly shown in the time-diagram of FIG. 6. The setting of the contact device 1', i.e. of the slider 2 with regard to the contact element 5, is selected so that the switching-off operation of this sliding contact occurs precisely at a full hour, i.e. at 6:00, 7:00 and the like o'clock. The releasing and resetting of the flip-flop therefore occur always through the switching-off of the capacitors C1, C2.

The circuit arrangement according to FIG. 3 has a specific advantage, namely that during the signaling the signal may be extinguished by operation of the signal switching-off key 14 irrespective of the pre-positioning of the starting point. A manual suppression of the signal is also possible when the setup signaling occurs within the range of a full hour and the contact device 1 or 1' (slider 2, contact element 5) is still closed during the signal delivery, though transitorily only and timely.

Figure 6:
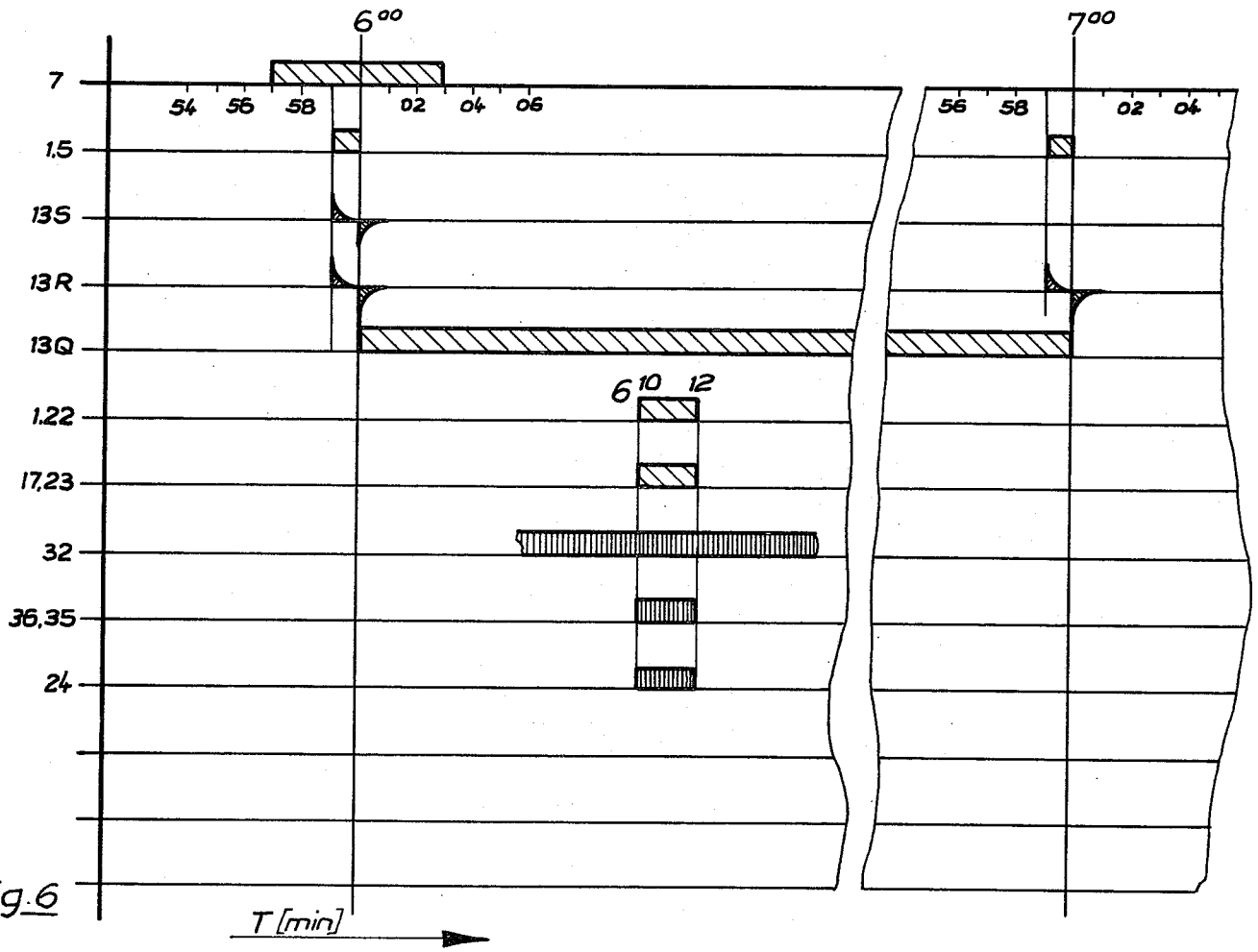
FIG. 6 is a time diagram for clarifying the functional steps of the circuit arrangement according to FIG. 3.

In the time-diagrams of FIGS. 4, 5 and 6, there are indicated on the ordinate the respective switching relative points for characterizing the individual time phenomena; the same designate:

7 — the contact device 7,
1,5 — the contact element 5 of the contact device 1,
13,S — the switching input of the flip-flop 13,
13,R — the reset input of the flip-flop 13,
13,Q — the output of the flip-flop 13,
1,22 — the contact element 22 of the contact device 1,
17,23 — the output 23 of the electronic circuit 17,
32 — the output of the frequency divider circuit 31,
36,35 — the output 35 of electronic circuit 36,
24 — the signal generator 24.

Figure 7:
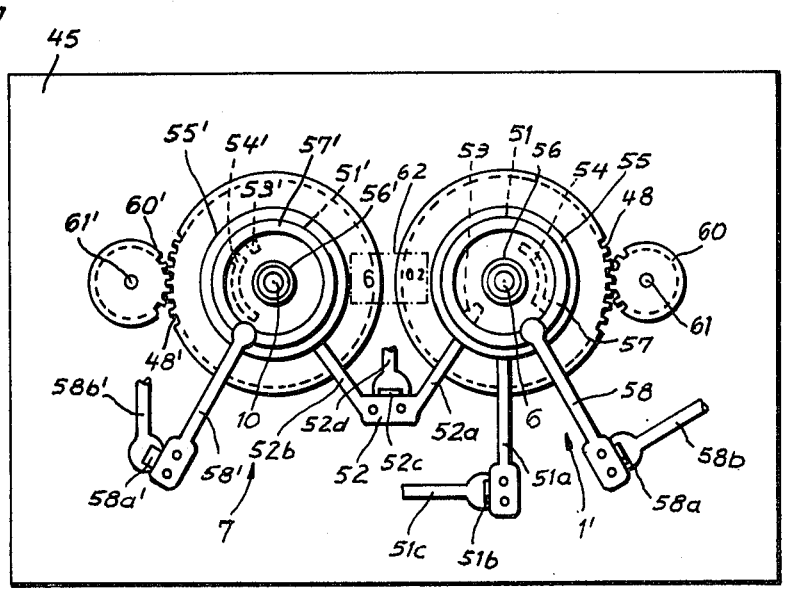
FIG. 7 is an illustration of one possible embodiment of the contact devices for a switching arrangement according to FIGS. 2 and 3 in one view.
Figure 8:
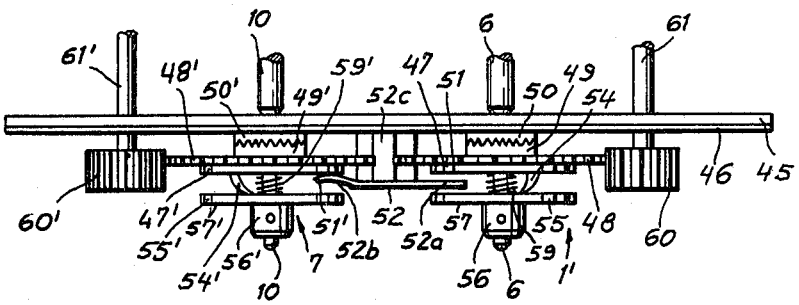
FIG. 8 is an illustration of the contact devices according to FIG. 7 in another view.

FIGS. 7 and 8 show in a side view the contact arrangement putting in effect the invention.

Both the driving shafts 6 and 10 are journaled on a slab of the time switching work; however, just the slab 45 is shown which is formed as a printed circuit board. This slab carries a coating 46 from which the printed lead paths are etched. The driving shaft 6 revolves in full within one hour, while the driving shaft 10 revolves in 24 hours. The driving shaft 6 has freely positioned thereupon a contact disc 47 carrying on a scale disc 48, the latter being indented around its periphery, and also an indexing rim wheel 49 combing a corresponding second rim wheel 50 on the slab 45.

The contact disc 47 carries a circular contact path 51 touched by a sliding spring 51*a* which is not fully visible.

This sliding spring 51*a* is mounted on a base on the slab 45 not illustrated in detail. The contact path 51 carries an electrically conductive lug 53 corresponding to the contact element 5 of the connecting arrangement being supported by a sliding spring 54 corresponding to the slider 2 of the contacting arrangement. This sliding spring is carried by a contact disc 55 mounted by a bushing 56 firmly to the driving shaft 6 and carrying in its turn and above located circular path 57 electrically connected to the sliding spring 54, the contact path being swept in a contact establishing way by a sliding spring 58 stationarily arranged on the slab 45.

Between the two contact discs 47 and 55, a coil spring 59 is located surrounding the driving shaft 6, which spring secures the necessary resting pressure between the parts 49 and 50. Another sliding spring 52 stationarily and firmly arranged on the slab 45 and corresponding to the contact element 5 of the contact device 1' projects at its end 52*a* into the support area of the sliding spring 54 and is touched thereby in a way providing contact each full hour. The indentation on the scale disc 48 is gear-toothed with a pinion 60 being mounted on a setting shaft 61 and settable from out side by a nonillustrated setting member (setting button, setting disc). The scale disc 48 carries inscriptions and its setting can be read of through a viewing window 62.

In order to clarify matters more distinctly, the construction of the contact devices 1' and 7 is shown in a distorted view in the axial direction of the driving shaft 6, 10. The actual construction of the contact devices 1', 7 may be more flat.

This contact arrangement described hereinabove and including the parts 47 – 61 functionally corresponds to the contact arrangement according to the invention, namely to the contact device 1'.

The structure of the contact device 7 of the switching arrangement is in essential features in agreement with the already hereinabove described arrangement.

On the driving shaft 10, there is arranged freely rotatably a contact disc 47' with a scale disc 48' and an indexing wheel 49'. The rim wheel 49' is engaged with the rim wheel 50' located on the slab 45. The contact disc 47' carries a contact path 51' being sensed by the end 52*b* of the contact spring 52. A lug 53' of this contact path 51' reaches into the sensing area of the sliding spring 54' and is touched thereby, thus establishing contact at the pre-set hour.

The sliding spring 54' is arranged on the contact disc 55' which is firmly connected to the driving shaft 10 by a bushing 56'. A contact path 57' fixed to the sliding spring 54' is sensed by a stationarily arranged sliding spring 58'. The scale disc 48' also is ciphered and the ciphers utilized are readable in the sight window 62, together with the ciphering of the scale disc 48 of the contact device 1' as a digital hour-minute indication of the set signal time.

Also in the contact device 7, the needed indexing force of the indexing rim wheels 49',50' is produced by a coil spring 59' interposed between the contact discs 47' and 55' and surrounding the driving shaft.

The building parts of the contact devices disclosed in the foregoing are advantageously produced from plastic material in plastic injection operations.

Switching attachments are effected on the contact devices 1', 7 through the sliding springs 52, 58, 58' and 51*a*. All four contact springs are preferably connected via the nose-like attachments 52*c*, 58*a*, 58*a'*, 51*b* to the lead paths 52*d*, 58*b*, 58*b'*, 51*c* which are etched out of the coating 46 of the slab 45.

The indexing means 49, 50 of the contact device 1' and 49', 50' of the contact device 7 allow a step-by-step resetting of the contact devices 1', 7, by action of a setting pinion 60' fixed on a shaft 61', to the intended time value which is readable from and through the viewing window 62. Such a resetting produces a relative positioning of the contact discs 47 and 47' regarding the contact discs 55 and 55' with the result that a signal is delivered in the indicator position on the time switching work corresponding to the digital time value readable through the sight window 62. Thereby, the following current circuits pass through the contact devices 1', 7:

(a) Triggering of the flip-flop 13: Lead path 58*b*, attachment 58*a*, sliding spring 58, contact path 57, sliding spring 54, contact spring end 52*a*, contact spring 52, contact spring end 52*b*, contact path 51', contact segment 53, sliding spring 54', contact path 57', sliding spring 58', attachment 58*a'*, lead path 58*b'*.

(b) triggering of the waking signal: Lead path 58*b*, attachment 58*a*, sliding spring 58, contact path 57, sliding spring 54, contact segment 53, contact path 51, sliding spring 51*a*, attachment 51*b*, lead path 51*c*.

(c) Decoupling of the flip-flop 13: Lead path 58*b*, attachment 58*a*, sliding spring 58, contact path 57, sliding spring 54, contact spring end 52*a*, contact spring 52, attachment 52*c*, lead path 52*d*.

The motion of the driving shaft 6 of the contact device 1' occurs intermittently in small steps, being in works controlled by quartz crystals, as a rule, second steps, while, in case of balance wheel controlled time switching works, the relatively high number of oscillations per unit time pratically leads to a continuous forward motion of the driving shaft.

The driving shaft 10 is operated in comparison with driving shaft 6 at a rotary speed slashed in relation 1:24, so that in view of the insignificant angular speed of this driving shaft 10 one can consider it to be a continuous rotative motion.

The invention provides a plurality of advantages:

The alarm readiness of the electrical signaling arrangement is fully automatically restored after a manually performed cancelation of the signaling.

A short, momentary actuation of the signal switch-off key suffices for a definite interruption of the signaling.

The control of the signaling occurs with a low energy consumption.

Thus also a very low wear of the contacts occurs since the contact operations are performed very lightly.

The light performance of the contacting operations means a minimum load for the driving or controlling time clockwork, this representing in case of run control by a balance wheel a very high precision of the run and a low current consumption.

The possible stiff connection between the driving shafts of the time work and the contact cam discs improves significantly the precision of the minute settable signaling.

We claim:

1. An electrical signaling arrangement especially for the production of waking signals at a predetermined instant in the course of a 24-hour cycle, said arrangement comprising:

a clockwork;

a first contact device operatively connected to said clockwork and switching on temporarily once at a predetermined moment in the course of a 24-hour cycle;

a second contact device operatively connected to said clockwork and electrically connected in circuit with said first contact device, said second contact device operating on a 60-minute cycle and closing an electrical contact for a brief period each hour, said first contact device being settable from hour to hour over said 24-hour cycle within one hour of said predetermined instant;

an electric holding circuit triggerable by said second contact device for producing an output, said holding circuit having a reset input energizable to terminate said output;

a third contact device operating on a 60-minute cycle connected to said clockwork and switching on at a selectable instant for a predetermined duration;

a logic circuit connected to the output of said holding circuit and to said third contact device for producing a control signal upon simultaneous energization by said output and said third contact device;

a waking signal generator connected to said logic circuit and energizable by the control signal therefrom; and means for automatically resetting said holding circuit to terminate the output thereof connected with one of said contact devices whereby the output from said holding circuit is terminated periodically and automatically.

2. The electrical signaling arrangement defined in claim 1, further comprising a manually operable signal-interrupting switch connected to said reset input for energizing same to terminate said output.

3. The electrical signaling arrangement defined in claim 2 wherein said first and third contact devices are manually settable step-by-step within the respective cycles and said first contact device switches on for a period shortly before said predetermined instant and switches off shortly thereafter.

4. The electrical signaling arrangement defined in claim 2 wherein said second contact device is connected to a terminal of an electric current source and in series with said first contact device to a switching input of said holding circuit, said holding circuit comprising a bistable multivibrator, said means for automatically resetting said holding circuit including a capacitor connecting said first contact device to said reset input, said third contact device being connected between said terminal and said logic circuit.

5. The electrical signaling arrangement defined in claim 2 wherein:

said second contact device is connected on one side to a terminal of an electrical potential source and on its other side to said first contact device;

said first contact device is connected in series with a first capacitor to a switching input of said holding circuit;

said holding circuit is formed with a bistable multivibrator having said switching input and said reset input;

said second contact device is connected in series with a second capacitor to said reset input of said bistable multivibrator, said capacitors and networks in circuit therewith being dimensioned such that the current traversing through said first capacitor flows for a longer period than the current through said second capacitor.

6. The electrical signaling arrangement defined in claim 2 wherein said holding circuit is an electronic bistable multivibrator.

7. The electrical signaling arrangement defined in claim 1 wherein said second and third contact devices are mounted upon a common support and have a common wiper.

8. The electrical signaling arrangement defined in claim 1, further comprising a second logic circuit having a first input connected to the output of the first-mentioned logic circuit, a second input, and an output connected to said signal generator;

a frequency divider having an output connected to the second input of said second logic circuit; and a signal generator operating said clockwork and connected to said frequency divider.

9. The electrical signaling arrangement defined in claim 1 wherein said circuits form part of a single integrated-circuit unit.

10. The electrical signaling arrangement defined in claim 9 wherein said clockwork includes a quartz crystal and an oscillator controlled by said quartz crystal and forming part of said integrated circuit unit.

11. The electrical signaling arrangement defined in claim 1 wherein said holding circuit is a bistable multivibrator having a set input, said set and reset inputs being connected by blocking diodes to a source of 0-potential.

12. The electrical signaling arrangement defined in claim 1 wherein said contact devices have manually settable contact elements at least in part formed by sliding contacts.

* * * * *